United States Patent [19]

Magendans et al.

[11] B 3,993,923

[45] Nov. 23, 1976

[54] COATING FOR X-RAY TUBE ROTARY ANODE SURFACE REMOTE FROM THE ELECTRON TARGET AREA

[75] Inventors: Frederik Magendans; Gerhardus Albertus te Raa, both of Eindhoven, Netherlands

[73] Assignee: U.S. Philips Corporation, New York, N.Y.

[22] Filed: Sept. 9, 1974

[21] Appl. No.: 504,056

[44] Published under the second Trial Voluntary Protest Program on February 24, 1976 as document No. B 504,056.

[30] Foreign Application Priority Data

Sept. 20, 1973 Netherlands ..... 7312945

[52] U.S. Cl. ..... 313/330; 313/60; 313/311

[51] Int. Cl.[2] ..... H01J 35/08

[58] Field of Search ..... 313/330, 311, 60

[56] References Cited

UNITED STATES PATENTS

| | | | |
|---|---|---|---|
| 1,579,779 | 4/1926 | Rentschler | 313/330 |
| 2,090,636 | 8/1937 | Olshevsky | 313/60 X |
| 3,761,761 | 9/1973 | Van Oostrom | 313/311 |
| 3,819,971 | 6/1974 | Kaplan et al. | 313/60 |

*Primary Examiner*—Saxfield Chatmon, Jr.
*Attorney, Agent, or Firm*—Frank R. Trifari; Ronald L. Drumheller

[57] ABSTRACT

A rotary anode for an X-ray tube in which the surface remote from the electron target area is covered with a metal oxide coating comprising at least 94 percent by weight $Al_2O_3$ and at least 2 percent by weight $TiO_2$.

10 Claims, 1 Drawing Figure

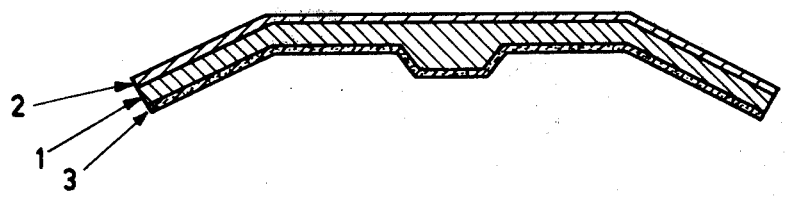
2
1
3

COATING FOR X-RAY TUBE ROTARY ANODE SURFACE REMOTE FROM THE ELECTRON TARGET AREA

The invention relates to a rotary anode for an X-ray tube having an electron target area consisting of tungsten or a tungsten alloy. The rotary anode may entirely consist of tungsten or a tungsten alloy or have a laminated structure in which the support consists of molybdenum or a molybdenum alloy. Such a laminated disc may be obtained, for example, by sintering layers of powders of the desired metals in a mould. According to a further method discs of the relevant metals are connected together under simultaneous reduction in thickness and enlargement of diameter of the two discs by means of one or a low number of strokes of large energy content between press blocks, whereafter a rotary anode is manufactured in known manner from the laminated body. The invention also relates to a method of manufacturing a rotary anode for an X-ray tube and to an X-ray tube provided with such a rotary anode.

An object of the invention is to enhance the performance under load of a rotary anode and hence the output of an X-ray tube provided with such an anode.

According to the invention this object is achieved by a rotary anode which is characterized in that the surface of the support remote from the electron target area is waked with a metal oxide coating comprising 94 to 98 % by weight of aluminium oxide and 2 to 6% by weight of titanium dioxide. The titanium dioxide may be present as a compound with part of the aluminium oxide.

It has been found that when using such a coating under an equal load, the temperature of the surface of the rotary anode remote from the electron target area assumes a value which is 150° to 250°C lower than a rotary anode without this coating. This means that the load of a rotary anode according to the invention can be increased by approximately 20% without any adverse effects on its lifetime.

In addition it has been found that the improved radiating power of rotary anodes according to the invention is maintained throughout the lifetime of the X-ray tube. In the radiation-improving coatings hitherto known this was not the case, which is probably the reason why the use of such coatings has not generally found its way in practice.

According to a preferred embodiment of the invention the surface of the support remote from the electron target area is coated with a mixture of metal oxides comprising 97.5 % by weight of aluminium oxide, 2 to 2.5% by weight of titanium dioxide and optionally other metal oxides. The thickness of the metal oxide coating is preferably between 20 and 100 micrometers. When using these coating thicknesses the underlying surface is satisfactorily covered and a sufficient thermal conductivity is ensured. In case of a thickness of less than 20 micrometers, particularly less than 10 micrometers the risk of an incomplete covering of the underlying surface is great. For a thickness of more than 100 micrometers the relatively poor thermal conductivity of aluminium oxide will play an increasingly important role. In case of thicknesses of more than 1000 micrometers the coatings come easily loose under the influence of internal stress.

It has been found in practice that it is advantageous to provide the coatings by means of a method in which the particles from which the coating is made up reach a temperature above the melting point of the metal oxide mixture. Suitable techniques are, for exaple, plasma spraying, powder spraying, wire spraying and detonation spraying. The particles may reach temperatures of 2500° to 5000°C.

Under these circumstances coatings are obtained which have a relative density of more than 90 % while the adhesion and the thermal conductivity of the coatings is optimum. If covered according to this method it is neither to be feared that gas is emitted during operation of the rotary anode in the X-ray tube where the rotary anode surface may reach temperatures of 1200°C or more. For this reason many other compounds, for example, chromium trioxide ($Cr_2O_3$) are found to be unsuitable for the envisaged object because decomposition occurs while possible satisfactory heat-radiating properties are lost and the vacuum in the X-ray tube deteriorates.

The invention will now be described in greater detail with reference to the accompanying drawing whose sole FIGURE shows a cross-section of an X-ray rotary anode according to the invention and an embodiment.

The FIGURE shows a cross-section of a rotary anode having a support 1 consisting of an alloy of molybdenum (known in the trade as TZM: 0.5 % by weight of Ti, 0.08 % by weight of Zr, remainder Mo) and an electron target area 2 of tungsten. The anode is obtained by connecting a flat disc of tungsten to a disc of the said molybdenum alloy with a single stroke of large energy content under reduction of the thickness and enlargement of the diameter. Subsequently the anode shown in a cross-section in the FIGURE is manufactured by a mechanical process from the laminated disc thus obtained.

EXAMPLE

The rotary anode (1,2) was coated with a coating having a thickness of 65 micrometers from a mixture consisting of 2.5 % by weight of $TiO_2$ remainder $Al_2O_3$ by means of plasma spraying. The support 1 reached a temperature at the surface remote from the electron target area which was 150° to 200°C lower under the same load than a rotary anode which was not provided with the coating 3 according to the invention. This means that the rotary anodes according to the invention have a longer lifetime. Other powder compositions which can be used in the invention are for example:

a. 2.5 % by weight of $TiO_2$, 2 % by weight of $SiO_2$, 1 % by weight of $Fe_2O_3$, remainder $Al_2O_3$, b. 0.5 % by weight of $SiO_2$, 3.3 % by weight of $TiO_2$, 0.15 % by weight of MgO, remainder $Al_2O_3$.

What is claimed is:

1. A rotary anode for an X-ray tube having an electron target area and a surface remote therefrom, comprising on the surface remote from the electron target area a metal oxide coating comprising at least 94 percent by weight aluminum oxide and at least 2 percent by weight titanium dioxide.

2. A rotary anode as defined in claim 1 wherein said metal oxide coating has a thickness of between 10 and 1000 micrometers.

3. A rotary anode as defined in claim 2 wherein the electron target area is a metal alloy consisting essentially of tungsten.

4. A rotary anode as defined in claim 2 wherein said metal oxide coating comprises approximately 97.5 percent by weight aluminum oxide.

5. A rotary anode as defined in claim 2 and further comprising a support plate of metal alloy consisting essentially of molybdenum supporting said metal oxide coating on one side thereof and covering the other side thereof a metal alloy coating for use as an electron target area, said metal alloy coating consisting essentially of tungsten.

6. A rotary anode as defined in claim 5 wherein said metal oxide coating consists essentially of aluminum oxide and titanium dioxide.

7. A rotary anode as defined in claim 5 wherein said metal oxide coating has a thickness of between 20 and 100 micrometers.

8. A rotary anode as defined in claim 7 wherein said metal oxide coating consists essentially of aluminum oxide and titanium dioxide.

9. A rotary anode as defined in claim 1 wherein said metal oxide coating has a thickness between 20 and 100 micrometers.

10. A rotary anode as defined in claim 9 wherein said metal oxide coating consists essentially of aluminum oxide and titanium dioxide.

* * * * *